United States Patent [19]

Cornils et al.

[11] Patent Number: 4,474,578

[45] Date of Patent: Oct. 2, 1984

[54] COAL/DIESEL FUEL SUSPENSIONS CONTAINING WAX-LIKE POLYMERS

[75] Inventors: Boy Cornils, Dinslaken; Müfit Bahadir, Zolling; John Hobes, Dinslaken; Winfried Materne, Wetter, all of Fed. Rep. of Germany Germany

[73] Assignee: Ruhrchemie Aktiengesellschaft, Fed. Rep. of Germany

[21] Appl. No.: 366,204

[22] Filed: Apr. 7, 1982

[30] Foreign Application Priority Data

Apr. 9, 1981 [DE] Fed. Rep. of Germany ..... 3114272

[51] Int. Cl.[3] ..... C10L 1/32

[52] U.S. Cl. ..... 44/51; 44/57; 44/62; 44/70

[58] Field of Search ..... 44/51, 57, 62, 70

[56] References Cited

U.S. PATENT DOCUMENTS

| | | | |
|---|---|---|---|
| 3,838,990 | 10/1974 | Mieville | 44/62 |
| 4,059,411 | 11/1977 | Smith | 44/51 |
| 4,130,400 | 12/1978 | Meyer | 44/51 |

*Primary Examiner*—William R. Dixon, Jr.
*Assistant Examiner*—Margaret B. Medley
*Attorney, Agent, or Firm*—Jordan B. Bierman; Linda Bierman

[57] ABSTRACT

The present invention relates to the stabilization of a carbonaceous combustible solid-diesel fuel suspension by inclusion therein of wax-like polymers in an amount of at least 0.2% by weight of the stabilized suspension. The polymers preferred are homopolymers of $\alpha$-olefins, and copolymers of ethylene and at least one other monomer copolymerizable therewith wherein the ethylene portion constitutes at least 60% by weight of the copolymer.

20 Claims, No Drawings

COAL/DIESEL FUEL SUSPENSIONS CONTAINING WAX-LIKE POLYMERS

This Application claims the priority of German Application No. P 31 14 272.9, filed Apr. 9, 1981.

The present invention is directed to a means for extending diesel fuel; more particularly, a composition comprising diesel fuel, a combustible solid, and a polymer suspending agent.

In an era when petroleum supplies are diminishing and demand for liquid fuels is increasing, it has become necessary to find methods of stretching available resources. One such method has been the addition of finely divided particles of a carbonaceous combustible solid to diesel fuel. The economic feasibility of this method depends heavily upon the availability of the solid used, as well as its heat content.

Investigations have most frequently been conducted with coal-diesel fuel suspensions, because of their high heat content and high thermal efficiency, as well as its relative abundance. These suspensions have been used as fuels to drive diesel motors, heat steam boilers, and generate heat in blast furnaces. A major disadvantage of these suspensions is the relatively rapid sedimentation of the particles even if they are finely ground. This results in storage and transportation problems, as the sediment may cause blockages in transportation systems. The addition of a suitable additive to significantly forestall the sedimentation would be extremely valuable.

Suitable additives must meet a number of different requirements. They must dissolve rather easily in diesel fuel. They should not substantially increase deposits that are formed by the diesel fuel in the combustion chamber or form their own deposits in the combustion chamber—in most instances, increased deposits decrease the efficiency of the diesel fuel—and they must substantially impede the sedimentation of the particles from the suspension.

It is, therefore, an object of the present invention to provide a composition wherein the additive meets the foregoing requirements.

It is also an object of the present invention to substantially reduce the sedimentation rate of a carbonaceous combustible solid present in a suspension thereof in diesel fuel.

It is a further object of the present invention to improve the transport and storage properties of suspensions of diesel fuel extenders, especially carbonaceous combustible solids, in diesel fuel.

SUMMARY OF THE INVENTION

Surprisingly, the above-mentioned problems have been solved by the addition to a suspension of a carbonaceous combustible solid in diesel fuel, a wax-like polymer in an amount of at least 0.2% by weight of the stabilized suspension.

Diesel fuel, as used in the present invention, is a heavy fuel oil which ignites spontaneously from compression; preferably a petroleum fraction with a boiling point within the range 80° C. to 350° C., more preferably with a boiling point in the range of 150° C. to 250° C.

The term carbonaceous combustible solid, as used herein, is intended to encompass any ground carbon-containing material capable of combustion and may include more than one such solid if they are mutualiy compatible. Coal is preferred, hard coal and brown coal are more preferred, and low ash coal is the most preferred. Other substances that can be used include sawdust and flour dust. The combustible solid should be ground as fine as possible in order to enhance its combustibility. Individual particles should be less than 100 microns, preferably between 20 and 90 microns in size. A particularly useful composition is one in which at least one third of the particles are less than 32 microns.

The coal used as the carbonaceous combustible solid can be ground in mills of known construction. Pinned disk mills, tooth mills and pack mills have all proved suitable. The coal can be ground dry and then mixed with the diesel fuel, or in the preferred method, the coal can be ground in the presence of the diesel fuel and the coal-diesel fuel ratio can be adjusted to the value it is intended to have in the finished suspension.

The compositions in which the present invention is effective comprise diesel fuel having up to about 50% by weight of a carbonaceous combustible solid, preferably coal, suspended therein. A total concentration of combustible solid greater than 50% by weight of the suspension is generally unsuitable due to adverse effects on flow behavior; however, where the flow behavior is not critical, greater concentrations may be used. The carbonaceous combustible solid is preferably present in an amount of at least 5% by weight of the suspension, more preferably bwetween 10% and about 30%.

In practicing the present invention, settling of the suspension is prevented or reduced by incorporating therein at least 0.2% by weight of at least one wax-like polymer. Increasing the wax-like polymer concentration improves the stability of the suspension until a limiting value is reached. Beyond this point, additional polymer does not significantly effect the rate of particle settling. This limiting value depends on the type of polymer, the type of combustible solid, and the particle size of the combustible solid. Of course, it is not economically practicable to use excess polymer, but this does not limit the operable scope of the invention. For example, the limiting concentration for a carbonaceous combustible solid concentration of 10% by weight of the stabilized suspension and having a particle size of less than 32 microns is about 2% by weight of the stabilized suspension.

The polymer additives of the present invention preferably have molecular weights of at least about 500. Increasing the molecular weight of the polymer lowers its solubility in diesel fuel and reduces its stabilizing effect. Therefore, it is a preferred embodiment of the invention that the wax-like polymers have molecular weights below approximately 10,000.

The wax-like polymers operable herein include olefin homopolymers, and copolymers of ethylene with at least one other copolymerizable monomer. Preferable olefin monomers are α-olefins having 4 to 12 carbon atoms, especially where the resultant polymer is atactic. Particularly suitable are poly-α-butene, poly-α-hexene, poly-α-octene, poly-α-decene and poly-α-dodecene.

The copolymer used should be made up of ethylene monomers in an amount of at least 60% by weight of the copolymer. The ethylene monomers are copolymerized with at least one other copolymerizable group which advantageously includes alkenes, preferably having 3 to 8 carbon atoms; alkenyl esters, preferably of 3 to 12 carbon alkene carboxylic acids; alkenyl halides, preferably vinyl fluoride and vinylidene fluoride; N-alkenyl compounds, preferably N-vinylpyrrolidone, N-vinyl carbazole, and N-vinylcaprolactam; acrylo- and methacrylo-compounds, preferably acrylamide, methacrylamide, acrylic acids, methacrylic acids, acrylonitrile and methacrylonitrile; alkenyl ethers; alkenyl alcohols; alkenyl ketones; other ethylenically unsaturated compounds; and inorganic polymerizable groups, preferably carbon monoxide and sulfur dioxide.

Particularly useful as the copolymer are ethylene-vinyl acetate and ethylene-acrylic acid copolymers wherein the vinyl acetate or acrylic acid monomer constitutes from approximately 2% to approximately 30% by weight of the copolymer, and in which the molecular weight of said copolymer is between 500 and 10,000.

The olefinic homopolymers and the copolymers are produced according to known methods; e.g. by high pressure polymerization at 1,900 to 4,000 bars and 150° C. to 350° C. in the presence of radical initiators, or by low pressure polymerization in the presence of Ziegler-Natta catalysts.

Tests showing the alteration in sedimentation rates are shown in Table 1 and were carried out in 1,500 milliliter measuring cylinders. Ground coal was suspended in a petroleum fraction having a boiling point between 180° C. and 260° C., and the time progression of separation of the clear and turbid phases was measured. The sedimentation rate was calculated from the initial slope of the settling curve.

The tests show that, by adding the wax-like polymer, the sedimentation rate of the coal particles in a high boiling petroleum fraction (diesel fuel) can be considerably and surprisingly reduced. The sedimentation rate depends on the grinding fineness of the coal and, as expected, coarse particles settle more quickly than fine particles. The sedimentation rate is also influenced by the wax-like polymer concentration, the higher concentrations impeding the sedimentation of the particles to a greater extent than the lower concentrations.

EXAMPLE (see table 1, example 4)

The following Example is set forth to illustrate the invention but do not limit its scope.

90 parts of diesel fuel are mixed with 10 parts ground bituminous coal (particle size: 34% 32μ). 1.8 percent by weight (based on the fuel) of copolymer wax are dissolved in the diesel fuel. The wax has a molecular weight of 2000, and contains 30% of vinyl acetate. The mixture is intensively stirred for 15 minutes, then transferred to a 1 l measuring vessel. Measurements are made of the separation rates between the clear and the turbid phases. The sedimentation rate is 0.046 mm/min; under exactly the same conditions omitting the addition of wax a sedimentation rate of 5.61 mm/min is recorded. The addition of wax thus decreases the sedimentation rate by a factor of 122.

TABLE I

| Example | Polymer wax Type | Comonomer content (%) | Mol. wt. | Polymer concentration (% by wt.) | Coal concentration (% by wt.) | Grinding fineness of the coal (% 32μ) | Sedimentation rate (SR) (mm/min) with additive | without additive | SR without additive / SR with additive |
|---|---|---|---|---|---|---|---|---|---|
| 1 | Ethylen-Copolym. | 30% VAC* | 3000 | 1,0 | 10 | 54 | 0,14 | 2,78 | 20 |
| 2 | Ethylen-Copolym. | 3% VAC* | 5000 | 1,0 | 10 | 100 | 0,64 | 1,48 | 2,3 |
| 3 | Ethylen-Copolym. | 5% AS** | 3000 | 1,0 | 10 | 100 | 0,41 | 1,48 | 3,6 |
| 4 | Ethylen-Copolym. | 30% VAC* | 2000 | 1,8 | 10 | 34 | 0,046 | 5,61 | 122 |
| 5 | Ethylen-Copolym. | 30% VAC* | 3000 | 1,8 | 10 | 100 | 0,096 | 1,48 | 15 |
| 6 | Ethylen-Copolym. | 30% VAC* | 3000 | 0,45 | 10 | 54 | 0,19 | 2,78 | 15 |
| 7 | Ethylen-Copolym. | 30% VAC* | 3000 | 1,0 | 30 | 54 | 0,15 | 0,34 | 2,3 |
| 8 | Polyhexen | — | | 0,5 | 10 | 54 | 0,20 | 2,78 | 14 |
| 9 | Polyhexan | — | | 1,0 | 10 | 54 | 0,14 | 2,78 | 20 |

*VAC = Vinyl acetate
**AS = Acrylic acid

We claim:

1. A composition comprising
(a) diesel fuel,
(b) carbonaceous combustible solid particles suspended therein, and
(c) a wax-like polymer dissolved in said fuel in an amount of at least 0.2% by weight of said composition, said polymer being
(1) an olefinic homopolymer or
(2) a copolymer of ethylene monomer and at least one other copolymerizable monomer wherein said ethylene monomer constitutes at least 60% by weight of said copolymer.

2. The composition of claim 1 wherein said particles are substantially all less than about 100μ in size.

3. The composition of claim 1 wherein said particles are present in an amount not greater than 50% by weight of said composition.

4. The composition of claim 3 wherein said polymer has a molecular weight between about 500 and about 10,000.

5. The composition of claim 3 or 4 wherein
(a) said olefinic homopolymer comprises α-olefinic monomers, and
(b) said copolymerizable monomers are selected from the group consisting of alkenes, alkenyl esters, alkenyl halides, N-alkenyl compounds, acrylo- and methacrylocompounds, alkenyl ethers, alkenyl alcohols, alkenyl ketones, other ethylenically unsaturated compounds, caron monoxide and sulfur dioxide.

6. The composition of claim 5 wherein said α-olefin monomer has 4 to 12 carbon atoms.

7. The composition of claim 6 wherein the olefinic homopolymer is atactic.

8. The composition of claim 7 wherein said homopolymer is poly-α-butene, poly-α-hexene, poly-α-octene, poly-α-decene or poly-α-dodecene.

9. The composition of claim 5 wherein said alkenes have 3 to 8 carbon atoms; said alkenyl esters are esters of 3 to 12 carbon alkene carboxylic acids or esters of alkenyl alcohols; said alkenyl halides are vinyl fluoride or vinylidene fluoride; said N-alkenyl compounds are N-vinyl pyrrolidone, N-vinyl carbazole or N-vinyl caprolactam; said acrylo and methacrylo compounds are acrylamide, methacrylamide, acrylic acids, methacrylic acids, acrylo nitrile and methacrylo nitrile.

10. The composition of claim 3 or 4 wherein said particles are present in an amount of at least 5% by weight of said composition.

11. The composition of claim 10 wherein said particles are present in an amount of between about 10% by weight of said composition and about 30% by weight of said composition.

12. The composition of claim 11 wherein said solid is coal, said copolymerizable monomer is vinyl acetate or acrylic acid, and said copolymerizable monomer constitutes at least 2% by weight of the copolymer, at least ⅓ of said particles are less than 32μ in size, and said diesel fuel has a boiling point from about 180° C. to about 260° C.

13. The composition of claim 12 wherein said copolymerizable monomer constitutes no more than 30% by weight of said copolymer.

14. The composition of claim 13 wherein said coal is hard coal, brown coal or low ash coal.

15. The composition of claim 4 wherein said solid is coal.

16. The composition of claim 5 wherein said coal is hard coal, brown coal, or low ash coal.

17. The composition of claim 4 wherein substantially all said particles are between about 20μ in size and about 90μ in size.

18. The composition of claim 17 wherein at least ⅓ of said particles are less than 32μ in size.

19. The composition of claim 4 wherein said diesel fuel is a petroleum fraction with a boiling point of about 80° C. to about 350° C.

20. The composition of claim 19 wherein said diesel fuel has a boiling point of about 150° C. to about 250° C.

* * * * *